United States Patent [19]

Brown

[11] Patent Number: 4,468,454

[45] Date of Patent: Aug. 28, 1984

[54] ANTIFOGGANT PROCESS

[75] Inventor: Clyde P. Brown, Pisgah Forest, N.C.

[73] Assignee: E. I. Du Pont de Nemours and Company, Wilmington, Del.

[21] Appl. No.: 503,296

[22] Filed: Jun. 10, 1983

[51] Int. Cl.[3] ..... G03C 1/02; G03C 1/06

[52] U.S. Cl. ..... 430/569; 430/607; 430/615; 430/611; 430/613

[58] Field of Search ..... 430/564, 567, 568, 569, 430/599, 600, 602, 607, 609, 613, 614, 611, 615, 631

[56] References Cited

U.S. PATENT DOCUMENTS

| | | | |
|---|---|---|---|
| 2,378,203 | 6/1945 | Fallesen | 430/607 |
| 2,384,613 | 1/1944 | Fallesen | 430/607 |
| 3,861,918 | 1/1975 | Fitzgerald | 430/599 |
| 3,957,490 | 5/1976 | Libeer et al. | 430/599 |
| 3,957,491 | 5/1976 | Ohi et al. | 430/600 |
| 4,323,645 | 4/1982 | Hall et al. | 430/564 |

*Primary Examiner*—Mary F. Downey

[57] ABSTRACT

Small amounts of organic oxidants are as effective in lowering fog in negative silver halide emulsion, when added prior to the end of digestion or chemical sensitization, as when higher amounts are added as after-additions.

5 Claims, No Drawings

ANTIFOGGANT PROCESS

TECHNICAL FIELD

This invention is in the field of photography, and more particularly relates to negative-working silver halide emulsions characterized by reduced fog and improved aging stability.

BACKGROUND OF THE INVENTION

A wide variety of organic and inorganic compounds are used for the complex series of steps by which a negative-working silver halide emulsion of high sensitivity is produced. One such step involves the chemical sensitization of the silver halide grains to increase their light sensitivity. Between the time of adding the sensitizer and coating the liquid emulsion, the latter is usually given a heat treatment, called digestion. During digestion a reaction is believed to occur which produces sensitivity sites on the surface of the silver halide grains. Unfortunately, as the digestion reaction is continued in order to obtain a higher level of sensitivity, some silver halide grains become spontaneously developable without exposure. This causes the emulsion to fog. Films made with grains which have undergone digestion to achieve high sensitivity not only exhibit this fog when tested shortly after being coated, but display higher levels of fog as the film is aged. This may reach a level such that the film is unusable and in any case limits the useful life of the film. Undesirable losses in sensitivity may also accompany the increase in fog as the film ages.

Efforts to obtain higher sensitivity for negative-working silver halide emulsions must in some fashion deal with the problem. An overall balance must be established between sensitizing effects which promote high speed and the associated tendency for fog, and stabilizing effects which lower the fog but tend to also lower speed.

It has been a common practice in the photographic art to characterize many of the additions made in the process as either predigestion additions or post digestion or after-additions. Gold compounds such as gold chloride and gold thiocyanate and sulfur compounds such as the thiosulfate and thiourea are well known in the art as predigestion additions for chemical sensitization (James, "The Theory of the Photographic Process," 3d Ed., pgs. 113–116 (1966)). They provide high speed emulsions, after a suitable digestion period; both inorganic and organic compounds are added to stabilize the emulsion. Such after-additions also lower the fog level, presumably by undoing some of the sensitization achieved by predigestion additions.

U.S. Pat. No. 4,323,645 discloses that certain organic halogen compounds such as p-nitrobenzyl chloride give reduced fog levels accompanied by little or no speed loss when added as after-additions, or even when in-line injected into the emulsion during the coating step to produce a photographic film. The present invention improves on the teachings of that patent by adding the same compounds to a silver halide emulsion to reduce emulsion fog, but is directed to the discovery that a much lower amount, if added earlier in the process, is equally effective.

SUMMARY OF THE INVENTION

It has been discovered that organic oxidants, i.e., bromine- and chlorine-substituted organic compounds which reduce fresh fog and/or prevent aging fog when added as after-additions or by in-line injection to a negative silver halide emulsion, can be equally effective when added during precipitation, redispersion, or digestion of the emulsion, and in a lesser amount than that required to reduce or stabilize fog when added as a post-digestion addition. Hence, the present invention is directed to a process of producing a silver halide-containing photographic film wherein a negative-working silver halide emulsion is, inter alia, chemically sensitized and digested, characterized in that a fog-reducing and/or age-stabilizing amount of a bromine- or chlorine-substituted organic compound is added to said negative-working silver halide emulsion at any stage of preparation prior to the conclusion of digestion, or of chemical sensitization. The compound is preferably p-nitrobenzyl chloride, 3-bromo-3-(4-nitrophenyl)-propionic acid, or 4-chloro-4-(p-nitrophenyl)-butyric acid.

It is an unexpected benefit of the predigestion addition process of the present invention that the fog lowering and age-stabilizing effect of an organic oxidant such as p-nitrobenzyl chloride when used as an after-addition can be accomplished with one-tenth that amount when added at precipitation, redispersion, or even during the chemical sensitization step.

DETAILED DESCRIPTION OF THE INVENTION

A more complete list of the organic oxidants, i.e., bromine- or chlorine-substituted organic compounds which may be added to a negative-working silver halide emulsion to lower fog and increase aging stability in accordance with the present invention, would include the following:

2,2,2-trichloroethanol, m-nitrobenzyl chloride, p-nitrobenzyl chloride, o-nitrobenzyl chloride, 3-chloroaniline, 2-chloro-4-nitrobenzyl chloride, 2-chloro-5-nitrobenzyl chloride, 4-chloro-2-nitrobenzyl chloride, 4-chloro-3-nitrobenzyl chloride, α,α,α-trichlorotoluene, o-chloranil, 4,6-dichloro-5-nitropyrimidine, 5-chloro-2-(trichloromethyl) benzimidazole, 2-chloro-3-nitropyridine, 2-amino-3,5-dichloropyridine, p-nitrobenzyl thiocyanate, chloro-(4-nitrophenyl)methane, 2-(p-nitrobenzyl) thiopyridinium bromide, 4'-chloro-4'-(4-nitrophenyl) butyric acid ethyl ester, 3-bromo-3-(4-nitrophenyl)-propionic acid, and 4-chloro-4-(p-nitrophenyl)-butyric acid.

These compounds lower the fresh and aging fog without adversely affecting speed, gradation, and top density of coated films when added in amounts of from 0.1 to 100 mg/mole of silver halide prior to the completion of chemical sensitization or digestion. These compounds may be conveniently added to the emulsion as early as the precipitation step by incorporation in one of the solutions used in the process such as, for example, the so-called gel salts solution (gelatin and alkali metal halide). Or it is possible to wait until the usual predigestion sensitizers have been added and the emulsion temperature has been raised to effect chemical sensitization, and to add an organic oxidant prior to the end of the digestion period. However, the difference between an addition made before, versus one made after the end of the digestion (the end being simultaneous with the addition of a quenching ingredient to the emulsion) is critical. It is believed that the unexpected effectiveness of lower amounts of organic oxidants added prior to the addition of quenching ingredients such as 4-hydroxy-6-methyl-1,3,3a,7-tetraazaindene, known to be a strong surface adsorbant on silver halide, is due to surface effects on the silver halide crystals. Hence, the present invention envisages adding the organic oxidant prior to completion of the digestion of the emulsion and addition of surface adsorbants.

The present invention is operative with silver halide grains produced by single jet, splash, and double jet precipitation techniques, to yield heterodisperse and monodisperse grain size distributions. Into the grains made by such known techniques metal ions may be introduced to modify the photographic response, and nonmetallic compounds may be added to increase sensitivity or restrain fog.

The silver halide constituent of the negative-working silver halide emulsions described herein may consist of pure or mixed silver chloride, bromide, or iodide, and the grains may be regular or irregular in shape, e.g., cubic, octahedral, rhombohedral, etc.

As a binder agent and peptizing media for these emulsions it is normal to employ gelatin. However, gelatin may be partially or wholly replaced by other natural or synthetic protective colloids known in the art.

Other useful additives include ortho- and panchromatic sensitizing dyes; speed-increasing compounds such as polyalkylene glycols; surface active agents which are useful as coating aids; antifoggants; and stabilizers, including indazoles, imidazoles, azaindenes, heavy metal compounds such as mercury salts, and polyhyroxy benzene compounds.

Other useful ingredients for these negative-working elements include hardeners, antistatic agents, matting agents, plasticizers, brighteners, and natural and synthetic wetting agents. All these ingredients may be combined to yield formulations capable of being coated on suitable supports such as cellulose nitrate film, cellulose ester film, poly(vinyl acetal) film, polystyrene film, poly(ethylene terephthalate) film, and related films as well as glass, paper, metal and the like.

The invention is illustrated by the following Examples.

EXAMPLE 1

A high speed silver iodobromide emulsion containing 1.2% iodide was prepared by the single jet method to produce a crystal size of 1.0 cubic microns using photographic grade limed bone gelatin, silver nitrate, ammonium bromide and potassium iodide. The emulsion was coagulated at 20° C. by slowly adding polyvinyl alcohol o-sulfobenzaldehyde acetal and lowering the pH to 2.0 with 3 N sulfuric acid. The coagulated emulsion was washed by decantation to remove the excess salts. The emulsion was then redispersed in gelatin, chemically sensitized with gold and sulfur, and digested by heating for 30 minutes at 57° C. At the end of the 30 minute digestion 4-hydroxy-6-methyl-1,3,3a,7-tetraazaindene and 1-phenyl-5-mercaptotetrazole were added to stabilize the emulsion. A first portion of this emulsion without further addition was coated on a support and overcoated with a gelatin solution containing formaldehyde hardener to serve as a control. A second portion received an addition of 100 mg/mole of silver halide of p-nitrobenzyl chloride and was then coated on a support and overcoated to serve as a prior art comparison according to U.S. Pat. No. 4,323,645, supra.

Four other precipitations were carried out to produce 1.0 cubic micron grains in the same manner as the control except that an addition of p-nitrobenzyl chloride was made to the gel salts solution to which the silver nitrate solution was added. Based upon the silver bromide in the resulting emulsion the additions were 0.5, 5.0, 10.0 and 100 mg per mole. These emulsions were redispersed, sensitized, coated and overcoated in an identical manner to the control and comparison.

Film samples of the control, the comparison, and the four experiments were exposed in a CRONEX sensitometer, available from E. I. du Pont de Nemours and Company, Wilmington, Del. and machine developed at 33° C. for 10 sec. in a continuous tone hydroquinone-containing developer having the composition enumerated in U.S. Pat. No. 4,383,023. Table 1 contains results of a sensitometric comparison between the samples containing an organic oxidant added according to the present invention and the control and prior art comparison.

TABLE 1

| Film | Precipitation Addition | After Addition | Relative Speed | Fog |
|---|---|---|---|---|
| Control | — | — | 100 | .08 |
| Prior Art | — | 100 mg | 105 | .06 |
| A | 0.5 mg | — | 100 | .08 |
| B | 5 mg | — | 104 | .06 |
| C | 10 mg | — | 96 | .06 |
| D | 100 mg | — | 75 | .01 |

As can be seen from the above, the 100 mg of p-nitrobenzyl chloride added at precipitation produces a considerable speed loss, whereas the same amount added after digestion according to U.S. Pat. No. 4,323,645 lowers fog without adverse effect on speed. However the 5 and 10 mg additions according to the present invention are roughly equivalent in lowering fog without adverse effect on speed.

EXAMPLE 2

An emulsion was precipitated and redispersed as per the control of Example 1. Portions of the redispersed emulsion were split into separate containers. Following the procedure in Example 1 both a control and comparison were prepared and coated. Other splits of the emulsion received all the same additions as the control except that 5 or 10 mg p-nitrobenzyl chloride per mole of silver halide were added to the redispersed emulsion 10 minutes before the sulfur sensitizer addition or 10 or 20 minutes after the sulfur sensitizer addition. These experimental emulsions were coated and tested as in Example 1 in comparison with the control which contained no addition of p-nitrobenzyl chloride, and the comparison which contained 100 mg added as an after addition.

The results showed that despite the wide range of timing in the p-nitrobenzyl chloride addition prior to the conclusion of the digestion reaction there was only a small difference in speed and no difference in fog compared to the 100 mg after addition. A slightly higher speed was observed for the films containing 10 mg as compared to the films containing 5 mg. These results indicate that the 30 minutes digestion period is not a significant factor in the fog lowering effect of the organic oxidants added prior to the quenching at the end of digestion according to the present invention. The 5 and 10 mg additions lowered fog equal to the 100 mg after additions whether present at digestion for 30, 20 or 10 minutes.

EXAMPLE 3

Equivalent splits of redispersed emulsion were prepared for chemical sensitization as in Example 2. One split was digested without the addition of an organic oxidant and served as a control. Other splits received the following 10 mg per mole of silver halide additions 10 minutes before the end of digestion and the quench addition of 4-hydroxy-6-methyl 1,3,3a,7-tetraazaindene:

p-nitrobenzyl chloride, 3-bromo-3-(p-nitrophenyl)propionic acid, 4-chloro-4-(p-nitrophenyl)butyric acid, 4'-chloro-4'-(4-nitrophenyl)butyric acid ethyl ester.

Sensitometric tests of film samples of emulsion coatings of the control and experiments showed that these bromine- and chlorine-substituted compounds all effectively lowered fog when added prior to the end of chemical sensitization.

EXAMPLE 4

Equivalent splits of redispersed emulsion were prepared for chemical sensitization as in Example 2. One split was digested without the addition of an organic oxidant and served as a control. Other splits were similarly digested up to the final 10 minutes of the chemical sensitization at which time varied amounts of p-nitrobenzyl chloride were added as follows: 0.4 mg, 5 mg, 10 mg, 22 mg, 44 mg; all per mole of silver halide. Sensitometric tests in comparison with Example 2 reconfirmed the effectiveness of the 5 mg and 10 mg level for lowering fog and additionally showed that 22 mg could be used without an adverse effect on speed. No benefit was observed for the 0.4 mg addition while the 44 mg addition gave a definite loss in speed.

I claim:

1. A process of producing a silver halide-containing photographic film wherein a negative-working silver halide emulsion is, inter alia, chemically sensitized and digested, characterized in that a fog-reducing and/or age-stabilizing amount of a bromine- or chlorine-substituted organic compound is added to said negative-working silver halide emulsion at any stage of preparation prior to the conclusion of digestion, or of chemical sensitization the aforesaid additive being a member selected from the group consisting of m-nitrobenzyl chloride, o-nitrobenzyl chloride, p-nitrobenzyl chloride, 2-chloro-4-nitrobenzyl chloride, 2-chloro-5-nitrobenzyl chloride, 4-chloro-2-nitrobenzyl chloride, 4-chloro-3-nitrobenzyl chloride, 4,5-dichloro-5-nitropyrimidine, 5-chloro-2-(trichloromethyl) benzimidazole, 2-chloro-3-nitropyridine, 2-amino-3,5-dichloropyridine, p-nitrobenzyl thiocyanate, chloro-(4-nitrophenyl) methane, 2-(p-nitrobenzyl) thiopyridinium bromide, 4'-chloro-4'-(4-nitro-phenyl) butyric acid ethyl ester, 3-bromo-3-(4-nitrophenyl)-propionic acid, and 4-chloro-4-(p-nitrophenyl)-butyric acid.

2. The process of claim 1 wherein the bromine- or chlorine-substituted organic compound is selected from the group consisting of p-nitrobenzyl chloride, 3-bromo-3-(4-nitrophenyl)-propionic acid, 4-chloro-4-(p-nitrophenyl)-butyric acid, and 4-chloro-4-(p-nitrophenyl)-butyric acid ethyl ester.

3. The process of claim 1 wherein said compound is added in an amount of 0.1 to 100 mg per mole of silver halide.

4. The process of claim 1 wherein digestion is concluded by the quench addition of 4-hydroxy-6-methyl 1,3,3a,7-tetraazaindene.

5. The process of claim 4 where the emulsion is a gelatino-silver iodobromide emulsion.

* * * * *